United States Patent [19]

Terpening

[11] 4,323,232

[45] Apr. 6, 1982

[54] EXERCISING METHOD

[75] Inventor: George I. Terpening, Telford, Pa.

[73] Assignee: Acro Matic, Inc., Warrington, Pa.

[21] Appl. No.: 836,401

[22] Filed: Sep. 26, 1977

[51] Int. Cl.[3] ..... A63B 21/18; A63B 21/30; A63B 69/36; A63B 69/38

[52] U.S. Cl. ..... 272/68; 273/183 B; 273/29 A; 128/327

[58] Field of Search ..... 128/327, 325, 95, DIG. 26; 273/189 R, 189 A, 29 A; 224/28 R, 28 D, 4 D; 24/16 PB, 198, 200, 206 R; 272/68, 67

[56] References Cited

U.S. PATENT DOCUMENTS

| | | | |
|---|---|---|---|
| 1,264,819 | 4/1918 | Lavin | 24/16 PB |
| 1,288,130 | 12/1918 | Nagelman | 128/327 X |
| 1,473,041 | 11/1923 | Henderson | 128/327 |
| 2,562,355 | 7/1951 | Grant | 24/206 R X |
| 3,877,426 | 4/1975 | Nirschl | 273/189 R X |
| 3,878,849 | 4/1975 | Muller et al. | 128/DIG. 26 |
| 3,913,179 | 10/1975 | Rhee | 24/16 PB |
| 3,970,081 | 7/1976 | Applegate | 128/95 |
| 4,061,340 | 12/1977 | Husted | 273/189 R |

*Primary Examiner*—George J. Marlo
*Attorney, Agent, or Firm*—William B. Noll

[57] ABSTRACT

A method involving a wriststrap adapted to improve and/or control the grip of a player involved in athletic activities, such as for example tennis and golf. The wriststrap preferably comprises a plastic strap to be worn about such player's wrist. The method requires the use of a strap provided with a protrusion mounted on the inside of said strap where the purpose of said protrusion is to apply localized pressure to the flexor capri ulnaris muscle near the base of such player's hand while the player is participating in an activity such as tennis or golf.

4 Claims, 5 Drawing Figures

EXERCISING METHOD

BACKGROUND OF THE INVENTION

This invention is directed to a wrist encircling device adapted to apply localized pressure to the flexor capri ulnaris muscle of the forearm. By way of example, applying such localized pressure allows the medial nerve to concentrate on the middle finger rather than the ring finger. Additionally, other muscles, such as the palmaris longus muscle, are strengthened.

Supports or pressure applying devices for arms and legs, specifically the type which encircles a portion of a limb, are well known in the prior art. Such supports run the gamut from elastic support hose or wraps, to more formal devices developed to alleviate specific problems such as "tennis elbow". U.S. Pat. No. 3,970,081, to Applegate, falls within the latter category. Applegate's device is a support to be worn on the arm near the elbow joint. Such support includes a tubular sleeve of one-way stretch fabric, an elastic strap attached to said sleeve and adapted to be tightened about the wearer's arm, and a pressure pad located in a pocket in said sleeve. The purpose of such support is to apply pressure to an area of the wearer's arm. Specifically, "it is felt that when the pad is worn laterally in the region of the radial head, it serves to support the orbicular ligament and stabilize the radial head in its relationship to the capitellum and the proximal ulna." In other words, such pressure helps to disengage the capitellum and proximal ulna muscles. It will minimize the irritation but not cure the problem.

U.S. Pat. No. 3,877,426 to Nirschl, is another wrap support for the forearm to prevent tennis elbow. The wrap support comprises a substantially curvilinear, arcuately shaped pad to be wrapped tightly about the muscle of the arm so as to apply circumferential pressure to a wide area of said muscle and thereby relieve internal tension on the said muscle.

Of the devices described by Applegate and Nirschl, each is relatively bulky. Such bulkiness, however, is not a detriment to the device's use as such device is worn just below the elbow of the forearm. Being sufficiently remote from the hand there is no problem with interference or restraint on the use of the wearer's hand. However, it will be appreciated that as the support or wrap of some sort gets closer to the hand, movement of the hand may be hampered. From a review of the description to follow it will be apparent that the present invention fulfills a critical need without hampering the wearer of the inventive device in his hand's motion or movements.

SUMMARY OF THE INVENTION

This invention is directed to a wriststrap device to be worn about a wearer's wrist just above the base of the hand. Such a device can be worn during such wearer's active involvement in an athletic activity such as tennis or golf. When such device is worn in a manner to apply localized pressure to such wearer's flexor capri ulnaris muscle an improved and/or more effective grip of the racket or club will be realized. The device preferably comprises a plastic strap having a protrusion mounted on the inside thereof. When such strap is in tension about the wearer's wrist the protrusion applies sufficient pressure to said muscle to effect the desired results.

DETAILED DESCRIPTION OF PREFERRED EMBODIMENT

Figure 1:
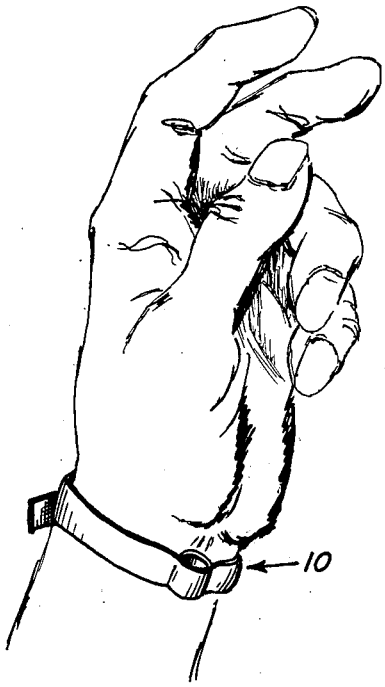
FIG. 1 is a perspective view of the wriststrap device of the invention in position about the wrist of a wearer thereof.

The perspective view of FIG. 1 shows a preferred form of the wriststrap 10 constructed in accordance with the present invention as positioned on the wearer's wrist just short of the palm of the hand.

Figure 2:
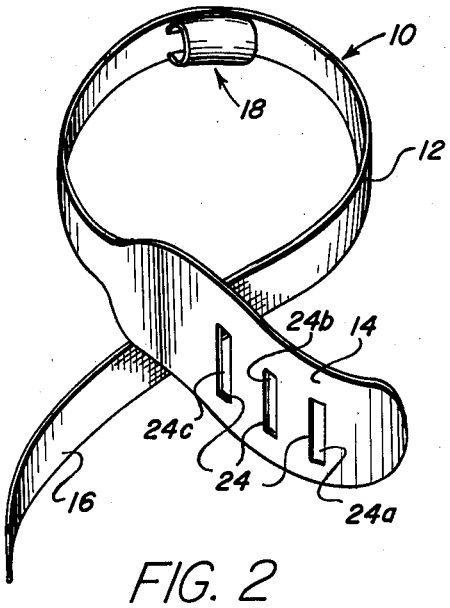
FIG. 2 is a perspective view of the wriststrap device of the invention in an insecured or free condition.
Figure 3:
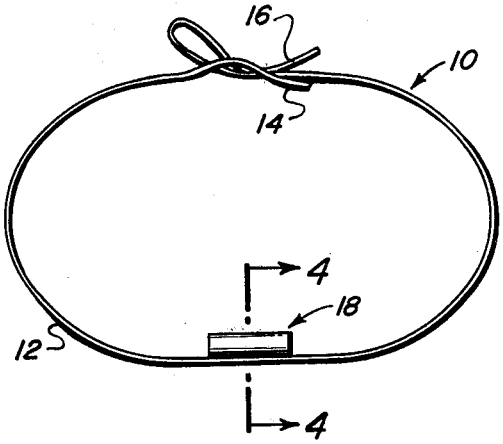
FIG. 3 is a top plan view of the wriststrap device of the invention in a secured position.

Looking to FIGS. 2 and 3 for full views of the wriststrap 10, it will be seen that said wriststrap 10 comprises a flexible, non-stretch strap 12, such as plastic, i.e. polyethylene, or the like, whose length is appreciably in excess of the girth of the wearer's wrist. As a consequence, the free ends 14 and 16 may overlap when the strap 12 is secured about a wearer's wrist, and that such free ends 14 and 16 may be fastened together to permit said wriststrap 10 to function in the prescribed manner. Such fastening will be described in more detail hereinafter.

Mounted on and adapted to apply pressure to the wearer's flexor capri ulnaris muscle is protrusion 18. The protrusion 18 is substantially inflexible such that it will not collapse when tension is applied to said strap 12. The width of strap 12, hence the protrusion 18, is quite narrow relative to the length of strap 12. Consequently, the pressure exerted by protrusion 18 on said muscle is localized.

Figure 4:
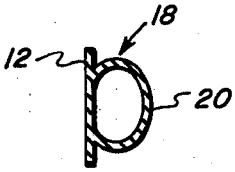
FIG. 4 is a sectional view along line 4—4 of FIG. 3.
Figure 5:
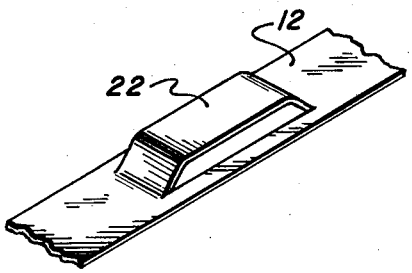
FIG. 5 is a partial perspective view of a modified pressure applying protrusion suitable for use in a wriststrap device according to the invention.

The protrusion 18 may assume a variety of shapes such as the cylindrical form 20 of FIG. 4, or the cut out extension 22 of FIG. 5. For additional stability the protrusion may be multi-layered or even solid.

FIGS. 2 and 3 illustrate the preferred manner in which the free ends 14 and 16 may be secured together. Free end 14 is broader in width than free end 16 and has been provided with a plurality of slots 24 (three slots **24*a*, 24*b*, 24*c* shown in FIG. 2), whose openings are sufficient to receive free end 16. To effect tightening of strap 12 about the wearer's wrist, free end 16 is (1) inserted through slot 24*a* and out slot 24*c*, (2) pulled taut, (3) turned back upon itself and (4) inserted sequentially through slots 24*b* and again through 24*a*. The strap fastening operation just described is illustrated in FIG. 3**.

The fastening mechanism used to secure strap 12 tightly about the wearer's wrist may be modified by means well known in the prior art. For example, cooperating VELCRO strips or tapes may be applied to the free ends 14 and 16. That is, one strip or tape may contain a plurality of loops while the cooperating strip or tape is provided with a plurality of hooks. In any case, this type of fastening means is well known in the art and described in patent literature such that further details thereon are believed necessary.

Although the present invention has been so far illustrated and described in its preferred embodiment, it also is to be understood that the invention is not limited only to such embodiment but may be modified or changed in various ways within the scope of the appended claims.

I claim:

1. A method of increasing the strength of a participant's grip involved in such activities as tennis or golf, by the application of localized pressure to the flexor capri ulnaris muscle at such participant's wrist just above the hand, comprising the steps of positioning a flexible, non-stretch strap about said wrist, which strap is provided with a protrusion mounted upon the inside of said strap for applying said localized pressure, applying pressure on said muscle by securing said strap in tension, and maintaining said tension by securing the free ends of said strap about said wrist during participation in said activities.

2. The method according to claim 1 wherein said strap is secured and maintained in tension about the participant's wrist by a strap end having three or more slots, and the other end of said strap passing through two of said slots and turned back upon itself.

3. The method according to claim 1 wherein said protrusion is substantially rigid when said strap is in tension about said participant's wrist.

4. The method according to anyone of claims 1 to 3 wherein said strap comprises a single piece of polyethylene.

* * * * *